US005544705A

United States Patent [19]

Jones et al.

[11] Patent Number: 5,544,705

[45] Date of Patent: Aug. 13, 1996

[54] METHOD FOR INJECTING FLUID INTO A WELLBORE

[75] Inventors: Richard R. Jones, Allen; William N. Wilson, Houston, both of Tex.

[73] Assignee: Atlantic Richfield Company, Los Angeles, Calif.

[21] Appl. No.: 372,459

[22] Filed: Jan. 13, 1995

[51] Int. Cl.[6] ..... E21B 33/16

[52] U.S. Cl. ..... 166/250.4; 166/291; 166/310; 166/155; 166/169

[58] Field of Search ..... 166/291, 286, 166/310, 162, 168, 169, 250.4, 250.14, 255.1, 155, 169

[56] References Cited

U.S. PATENT DOCUMENTS

| | | | |
|---|---|---|---|
| 2,968,351 | 1/1961 | Jones | 166/162 |
| 3,104,715 | 9/1963 | Robinson, Jr., et al. | 166/310 X |
| 3,212,576 | 10/1965 | Lanmon II | 166/286 X |
| 4,191,254 | 3/1980 | Bughman | 166/295 X |
| 4,361,187 | 11/1982 | Luers | 166/326 |
| 4,846,279 | 7/1989 | Bruce | 166/310 |
| 4,953,620 | 9/1990 | Bloys et al. | 166/293 |
| 4,976,316 | 12/1990 | Carpenter et al. | 166/291 |
| 5,005,646 | 4/1991 | Bloys et al. | 166/293 |

*Primary Examiner*—Stephen J. Novosad
*Attorney, Agent, or Firm*—Jack D. Stone

[57] ABSTRACT

A method for injecting fluid, such as an accelerator, into a wellbore comprises storing the fluid in a reservoir, locating the reservoir downhole in the wellbore, and then transferring the fluid from the reservoir into the wellbore. More particularly, one embodiment of the method comprises storing the fluid in a reservoir in a plug, pumping the plug down casing in a wellbore, and transferring the fluid at the bottom of the wellbore via a venturi effect. Another embodiment of the method comprises storing the fluid in a reservoir integrated into the wall of a portion of casing, setting the casing in the wellbore, and then transferring the fluid via a venturi effect from the reservoir into the annulus defined between the casing and the wellbore.

26 Claims, 5 Drawing Sheets

METHOD FOR INJECTING FLUID INTO A WELLBORE

BACKGROUND OF THE INVENTION

1. Field of the Invention

The present invention relates to a method for injecting fluid into a wellbore and, more particularly, to a method for injecting fluid, such as an accelerator, into a cement slurry in a subterranean wellbore.

2. Description of the Prior Art

Well established methods are employed in oil and gas exploration for cementing-in a wellbore that penetrates subterranean formations. Typically, casing is installed in the wellbore, displacing mud therein. The outside diameter of the casing is smaller than the inside diameter of the wellbore, providing thereby an annular column, or annulus, between the casing and the wellbore. In a primary cementing job, cement is pumped into the annulus to bond the casing to the earth formation of the wellbore, protect the casing against corrosive gases and liquids, and provide zonal isolation which prevents vertical communication of fluids along or within the annulus or otherwise through the column.

In a typical primary cementing job, a bottom, hollow-core, diaphragm plug is pumped (run) down the interior of the casing using a cement slurry. After sufficient cement slurry to fill the annulus has been pumped down the casing, a top, solid-core plug is pumped down the casing using displacement fluid such as mud. The bottom and top plugs protect the cement slurry from contamination by mud which precedes the bottom plug and follows the top plug. The bottom plug moves downwardly until it comes to rest at the casing shoe, at which time pressure builds up in the slurry above the bottom plug and ruptures the diaphragm therein. The cement slurry then passes down through the bottom plug and the bottom of the wellbore and up into the annulus. The top plug continues to move downwardly until it comes to rest on top of the bottom plug, at which time the annulus should be substantially filled with cement slurry, thereby completing the cementing operation. The cement slurry is then allowed to set up or harden in the annulus, forming thereby a rigid annular column between the casing and the earth formation of the wellbore.

Spacer fluids, such as soap-water mixes or weighted polymer fluids compatible with both mud and cement, are often used to perform, in the annulus, the functions performed by the plugs in the casing. That is, the spacer fluids are run before and after the cement to flush the mud out of the annuls before the cement slurry enters the annulus and to keep the mud and the cement separate in the annulus.

The time required for cement to set, which is often referred to as the "waiting-on-cement" (WOC) time, may range from several days up to a week. WOC time is costly because it represents downtime during which drilling equipment is idle. Furthermore, a long WOC time increases the probability that cement may fall back into the casing, or into a "rat hole," or the like, thereunder, and that gaseous or liquid fluids from a reservoir may invade and weaken the cement column while the cement is in transition from a liquid to a solid state (the "transition-to-set" time). To reduce the WOC and transition-to-set times, as well as the cement slurry thickening (hardening) time, common accelerators, such as calcium chloride, sodium chloride, sodium metasilicate, and others well known to the art, are often blended at the surface of the wellbore with bulk cement or prepared cement blends and mix water. These accelerator-treated cement slurries are then pumped down the well. Because several hours may elapse before such slurries reach the bottom of deep wells, if accelerators are not controlled, they may cause the cement slurry to set prematurely while still in the casing, thereby preventing the slurry from being run into the annulus and, furthermore, requiring the subsequent removal of hardened cement from the interior of the casing. To ensure against such a premature set, a "safety factor" is included in the calculated thickening time, thus further reducing the usefulness of these types of accelerators in deep wells.

Other accelerators, such as amines, amides, and organic acids, all well known in the art, will also accelerate cement slurries and provide the same desired properties mentioned above. However, these accelerators typically have uncontrollable behaviors and, for that reason, may not be preblended at the surface with the cement slurry.

One attempt to reduce, or accelerate, the WOC time has been to use an accelerating overwash similar to that used in permafrost applications in which coil tubing is run down the wellbore and cement, followed by a spacer fluid, is pumped therethrough. The cement is partially set or dehydrated and the accelerating overwash is then pushed through the partially set matrix or permeability of the cement resulting in some acceleration of the WOC time. However, in conventional cementing practice, this method is limited due to (1) the high potential for contamination of the treating fluid with displacing fluids such as drilling muds, (2) the volume of additives required to condition a much larger slurry volume and, (3) the inability of the accelerator to control the slurry in the annulus or even to mix sufficiently with the cement slurry at the casing shoe.

In addition to accelerators, it may also be necessary to mix other additives with the cement slurry to effect one or more of the following: retard the cement set, control fluid minimize or stop fluid or gas migration, increase the gel strength or thixotropic behavior of the cement, nullify the contamination and over-retardation effects of mud on the cement, or improve the cement's bonding.

A device developed for injecting chemical additives into subterranean wellbores is shown in U.S. Pat. No. 4,361,187 to Luers which discloses a downhole mixing valve for such applications as cementing or fracturing wells. This valve is generally mounted on tubing which is run into a wellbore casing. A first fluid is pumped down the tubing while a second fluid is pumped down an annulus formed between the tubing and the casing and the two fluids are mixed at the mixing valve. However, there are several disadvantages to such a device. For example, if displacement fluid is used to pump the first and second fluids down the tubing and the annulus, then the fluids will inevitably become contaminated. If displacement fluid is not used, then an exorbitant, very uneconomical, quantity of first and second fluids will be required to fill the tubing and the annulus. Furthermore, Luers requires that the two fluids converge at the mixing valve at the same time, a very difficult task. Such a device would also be impractical for cementing an entire wellbore annulus, and only one such device could be used in a wellbore at a time. Moreover, such a device requires an additional trip mechanism with the tubing which increases the costs and time required for cementing operations.

In view of the foregoing, what is needed is a method for reducing cement slurry thickening, transition-to-set, and WOC times in a manner that can be controlled, even in deep wellbores, without premature setting of the cement.

SUMMARY OF THE INVENTION

The foregoing problems are solved and a technical advance is achieved by a method in which fluids, such as accelerators, are injected downhole into a wellbore. In a departure from the art, the method comprises storing a first fluid, such as an accelerator, in a reservoir or device; disposing of or locating the device or reservoir downhole in a wellbore; and then causing the device or reservoir to inject or transfer the first fluid into a second fluid, such as a cement slurry, at a desired time and location in the wellbore.

In one embodiment of the invention, the reservoir is defined by an annular space surrounding a central passageway in a plug. The reservoir is provided with openings through which the first fluid may flow from the reservoir into the passageway. The plug is then pumped down to the bottom of the casing in a conventional manner. The second fluid is then caused to flow through the passageway so as to create a pressure drop and venturi effect across the openings, thereby inducing the first fluid to flow out from the reservoir through the openings and into the second fluid in the passageway.

In another embodiment of the invention, the reservoir is defined by an annular space enclosed within the wall of a portion of casing. The casing is set in the wellbore. The reservoir is provided with openings through which the first fluid may flow from the reservoir into an annulus defined between the casing and the wellbore. The second fluid is then caused to flow through the annulus so as to create a pressure drop and venturi effect across the openings, thereby inducing the first fluid to flow out from the reservoir through the opening and into the second fluid in the annulus.

Many advantages are achieved with this invention, including control, or a reduction, of cement slurry thickening time, transition-to-set time, and compressive strength development (and consequent WOC) time, without causing the cement to set prematurely in associated casing. Some consequences of controlling or accelerating these slurry properties include the reduction of over-retardation resulting from mud contamination, minimization of gas and fluid migration, control of lost circulation, and elimination of cement fall-back or U-tubing.

Many further advantages are also achieved with the present invention. For example, well testing, logging, drill-out, and completion procedures may be safely started earlier. Less time is required to meet Federal, State, and local government regulations governing cement set procedures. Zonal isolation is maximized by promoting cement set before gas encroachment can create channels through the annulus. Extra thickening time can be designed into slurries to relax thickening times for pumping safety and control standards, thereby minimizing the degree of laboratory support required. Wet shoes and damage to primary cement jobs by early shoe tests may be minimized. The compressive strength and ductility of hardened cement is improved. Quicker setting cement squeezes, resulting in better, more cost effective remedial applications, may be performed. Quicker hardening cement plugs may be utilized for whipstocking or well abandonment. Treating fluids may be separately disposed as preflushes or overflushes to the cement in the wellbore, though effective treatment through commingling of two fluid phases is restricted to the fluid interfaces.

Several further advantages result from the second embodiment described above, that is, from storing fluid in a reservoir integrated into a casing wall. For example, fluid may be injected anywhere in the upper or lower region of the wellbore where there may exist, for example, a weak zone, a gas invasion problem, lost circulation, or significant changes in thermal gradients which further affect conventional practices. Furthermore, cement slurry, including lead slurry (i.e., slurry intended for the upper region of the annulus), may be flash-set before it gets contaminated or diluted, and external casing packers may be obviated.

DESCRIPTION OF PREFERRED EMBODIMENTS

Figure 1:
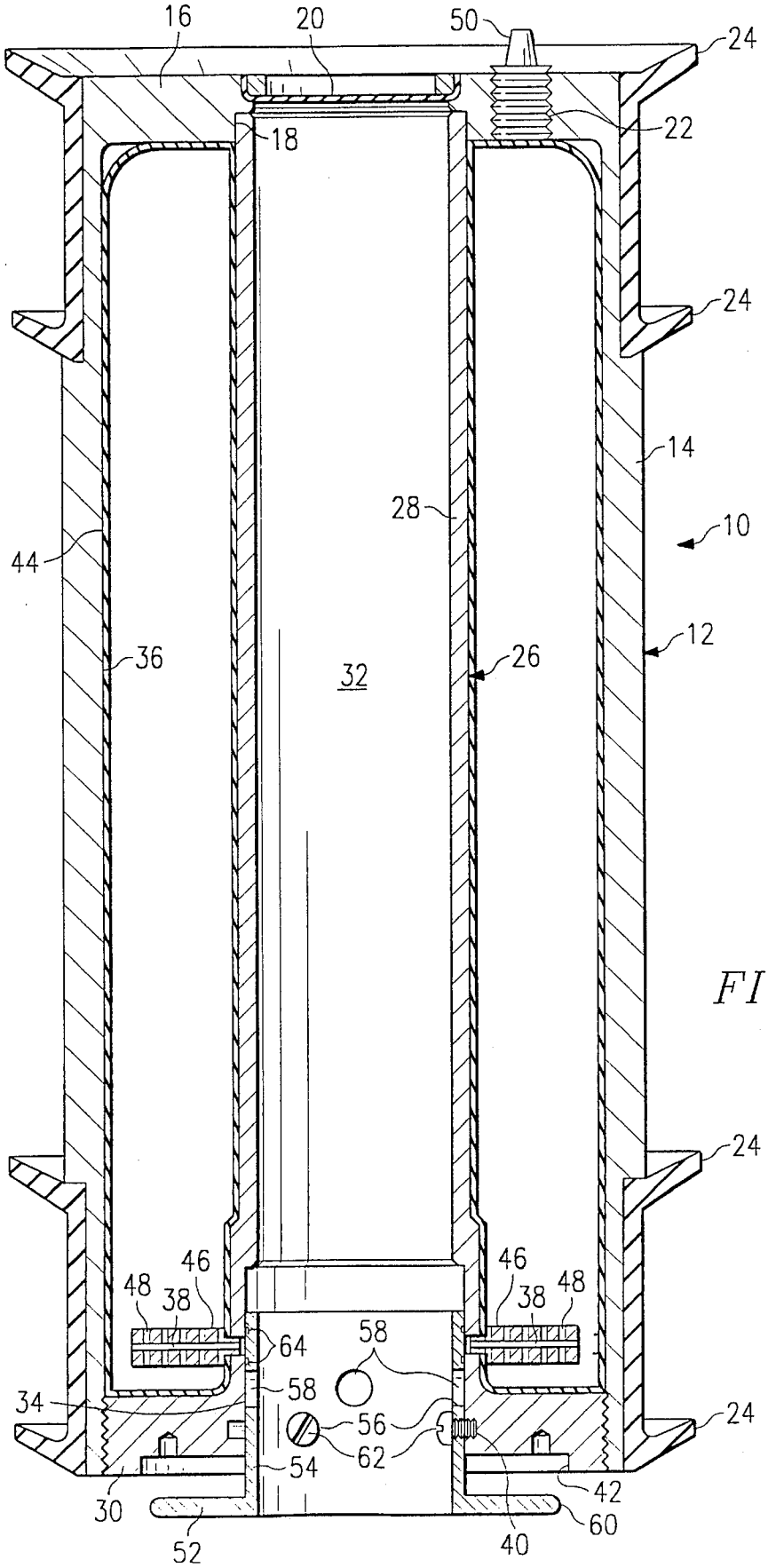
FIG. 1 is a cross-sectional, elevational view of a first preferred embodiment of a downhole injection plug that may be utilized to implement the method of the present invention.

In FIG. 1, the reference numeral 10 designates a first embodiment of a downhole injection plug that may be used to implement the method of the present invention. As shown therein, the plug 10 includes a cylindrical housing 12 having a substantially cylindrical outer wall 14 and an upper end portion 16 extending radially inwardly from the upper end of the wall. An opening 18, concentric with the wall 14, is formed extending through the upper end 16. The opening 18 is sealed off by a diaphragm 20 which may be ruptured upon the application to the diaphragm of a predetermined pressure, as will be described. An additional opening 22 is formed through the upper end portion 16 intermediate the opening 18 and the wall 14. Preferably, a plurality of pliable wiper blades 24 are provided encircling the upper and lower portions of the outside of the wall 14.

A mandrel 26 is secured within the housing 12 and includes a substantially cylindrical inner wall 28 having an upper end portion seated against the periphery of the opening 18, and a lower flanged end portion 30 extending radially outwardly therefrom. The inner wall 28 defines a central cylindrical passageway 32 extending longitudinally through the housing 12. In the lower portion of the passageway 32, a counterbore 34 is formed which is concentric with, and has a slightly larger diameter than, the passageway 32. An annular chamber 36 is defined by the inside of the outer wall 14, the inner wall 28, the upper end 16, and the lower end 30. Four angularly spaced fluid metering orifice ports (or openings) 38 (two of which are shown) extend radially through the lower portion of the wall 28 from the chamber 36 into the counterbore 34. Three spaced counterbore openings 40 are also formed extending radially from the counterbore 34 into the flange 30. A recess 42 is formed on the bottom side of the flange 30, which recess is concentric with, and extends radially and outwardly from, the counterbore 34.

An elastomer bladder 44 is disposed inside, and substantially fills, the annular chamber 36. Four orifice blocks 46, each of which define a plurality of orifices 48, are evenly spaced, and secured to, the lower inner portion of the bladder 44 such that the blocks align with and engage the orifice ports 38, thereby establishing fluid communication between the interior of the bladder 44 and the counterbore 34. The upper portion of the bladder 44 includes a filling stem 50 extending through the opening 22, which stem has a conventional back check valve (not shown) to permit the bladder to be precharged with a fluid, such as a cement slurry accelerator, but to prevent such fluid from discharging therefrom.

A sliding valve sleeve 52 is disposed in the counterbore 34 and includes a cylindrical wall 54 having three sleeve holes 56, four sleeve ports (or openings) 58, and a flange 60 extending radially outwardly from the bottom thereof. The wall 54 and the flange 60 are sized so that the sleeve 52 can slide within the counterbore 34 and so that the flange may be received by the recess 42. The sleeve 52 has a hollow core sized to form substantially an extension of the central passageway 32.

The sleeve 52 is disposed within the counterbore 34 such that the sleeve flange 60 is spaced outwardly from the counterbore, as shown in FIG. 1. The three sleeve holes 56 are arranged on the sleeve 52 to correspond and align with the three counterbore openings 40. Three shear pins 62 are provided which extend through the corresponding aligned sleeve holes 56 and counterbore openings 40 thereby substantially securing the sleeve 52 relative to the counterbore 34. The shear pins 62 are sized so that they will shear when a predetermined longitudinal load is applied to the wall 54 and the sleeve flange 60. Two O-rings 64 are arranged on the circumference of the sleeve 52 for sealing the orifice ports 38 and containing fluid within the bladder 44.

Figure 2:
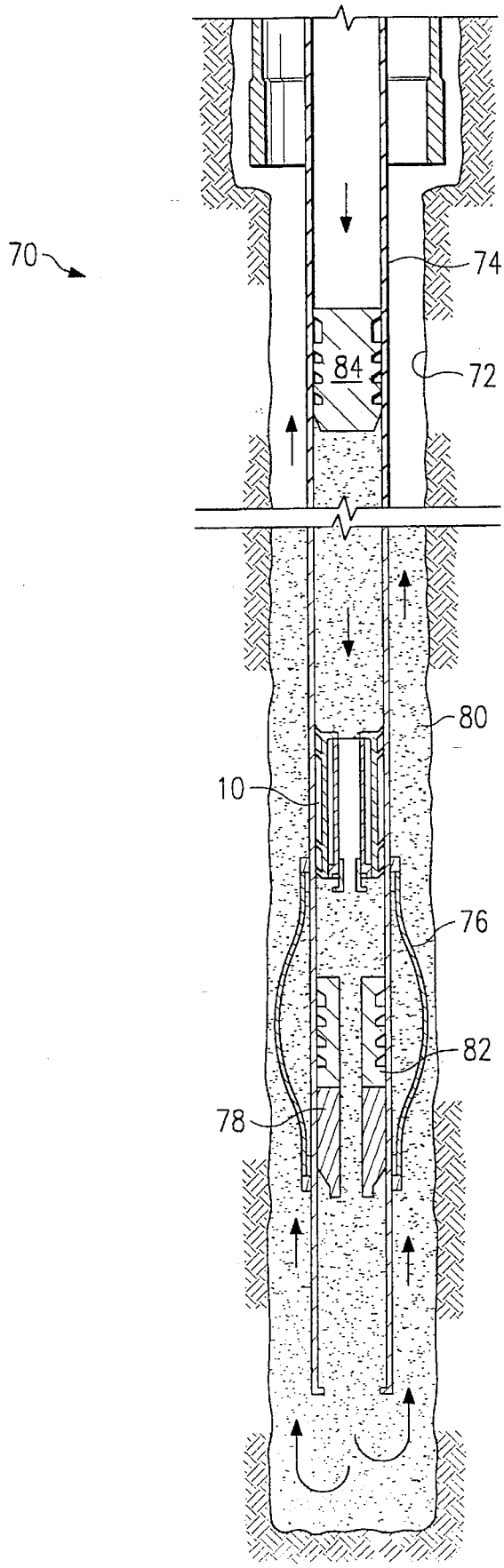
FIG. 2 is a cross-sectional, elevational view of a case cementing system in which the plug of FIG. 1 may be utilized.

In FIG. 2, the reference numeral 70 designates a case cementing system in which the downhole injection method of the present invention may be implemented utilizing the plug 10. The cementing system 70 is designed to operate in subterranean wellbore 72 and includes a string of casing 74 and a plurality of centralizers 76 for centering the casing in the wellbore. The casing 74 includes a float collar 78 secured to the casing a short distance up from the bottom of the casing. An annulus 80 is defined between the wellbore 72 and the casing 74.

During a primary cementing operation, a conventional bottom cementing plug 82 and top cementing plug 84 are provided in addition to the plug 10. The bottom plug 82 has a hollow core sealed with a rupturable diaphragm (not shown), and the top plug 84 has a solid core. Both plugs 82 and 84 are designed to prevent the mixing of fluids above and below the diaphragm or solid core and to permit a differential pressure to be applied across the plugs so that the plugs may be pumped down the casing 74. To this end, the plugs 82, 84 are further provided with conventional wiper blades similar to the wiper blades 24 on the injection plug 10 (FIG. 1). The wiper blades wipe the inside surface of the well casing 74 free of drilling mud or other fluids present therein and sealingly separate the fluids above and below the respective plugs (e.g., mud below and cement slurry above the bottom plug), thereby minimizing contamination of the cement slurry by mud.

In accordance with the method of the first embodiment of the present invention, the casing 74, including the float collar 78, is set in the wellbore 72 as shown in FIG. 2, and the bottom plug 82 is pumped down the casing 74 using a "lead" cement slurry. After a pre-determined amount of cement slurry has been pumped down the casing 74, the downhole injection plug 10, precharged with fluid and having the sleeve 52 spaced outwardly therefrom as shown in FIG. 1, is pumped down the casing using additional, or "tail," cement slurry. After a pre-determined amount of additional cement slurry has been pumped down the casing 74, the top plug 84 is pumped down the casing using displacement fluid such as mud.

The bottom plug 82 moves downwardly until it comes to rest on the float collar 78, at which time the slurry pressure above the plug is increased momentarily until the diaphragm on the plug is ruptured. The cement slurry then begins to pass downwardly through the hollow core of the bottom plug 82, the float collar 78, the bottom of the casing 74, and upwardly into the annulus 80.

The injection plug 10 moves downwardly until the sleeve 52 and the sleeve flange 60 impact the bottom plug 82, thereby shearing the shear pins 62 and causing the sleeve to slide upwardly into the counterbore 34 until the sleeve flange is seated within the recess 42 and is flush with the bottom of the mandrel flange 30. Slurry pressure is then increased momentarily until the diaphragm 20 on the injection plug 10 is ruptured. The cement slurry then passes downwardly through the central passageway 32 and the sleeve 52 of the injection plug 10, the bottom plug 82, the float collar 78, the bottom portion of the casing 74, and upwardly into the annulus 80.

In addition to the foregoing, with the sleeve 52 fully disposed within the counterbore 34, the orifice ports 38 and the corresponding sleeve ports 58 align with each other, thereby establishing fluid communication between the interior of the bladder 44 and the interior of the sleeve. Furthermore, because the inside diameter of the sleeve 52 is less than that of the casing 74, the velocity of the fluid passing through the sleeve is greater than through the casing. Therefore, as the cement slurry passes through the sleeve 52, a venturi effect is generated across the sleeve ports 58 in a manner commonly understood in the art, thus creating a pressure drop at the sleeve ports. At the same time, pressure on the bladder 44 and fluid therein is equalized, via the stem 50, with the pressure of the cement slurry above the injection plug 10. As a consequence, because pressure above the injection plug 10 is greater than the venturi pressure drop at the sleeve ports 58, a differential pressure is created between the bladder 44 and the sleeve ports, thereby causing fluid to flow outwardly from the bladder through the ports 38 and 58 into the sleeve 52 and to mix with the cement slurry as the slurry flows through the passageway 32.

The top plug 26 continues to move downwardly until it comes to rest on the injection plug 10, thereby terminating the cementing operation (except, of course, for the WOC time).

Figure 3:
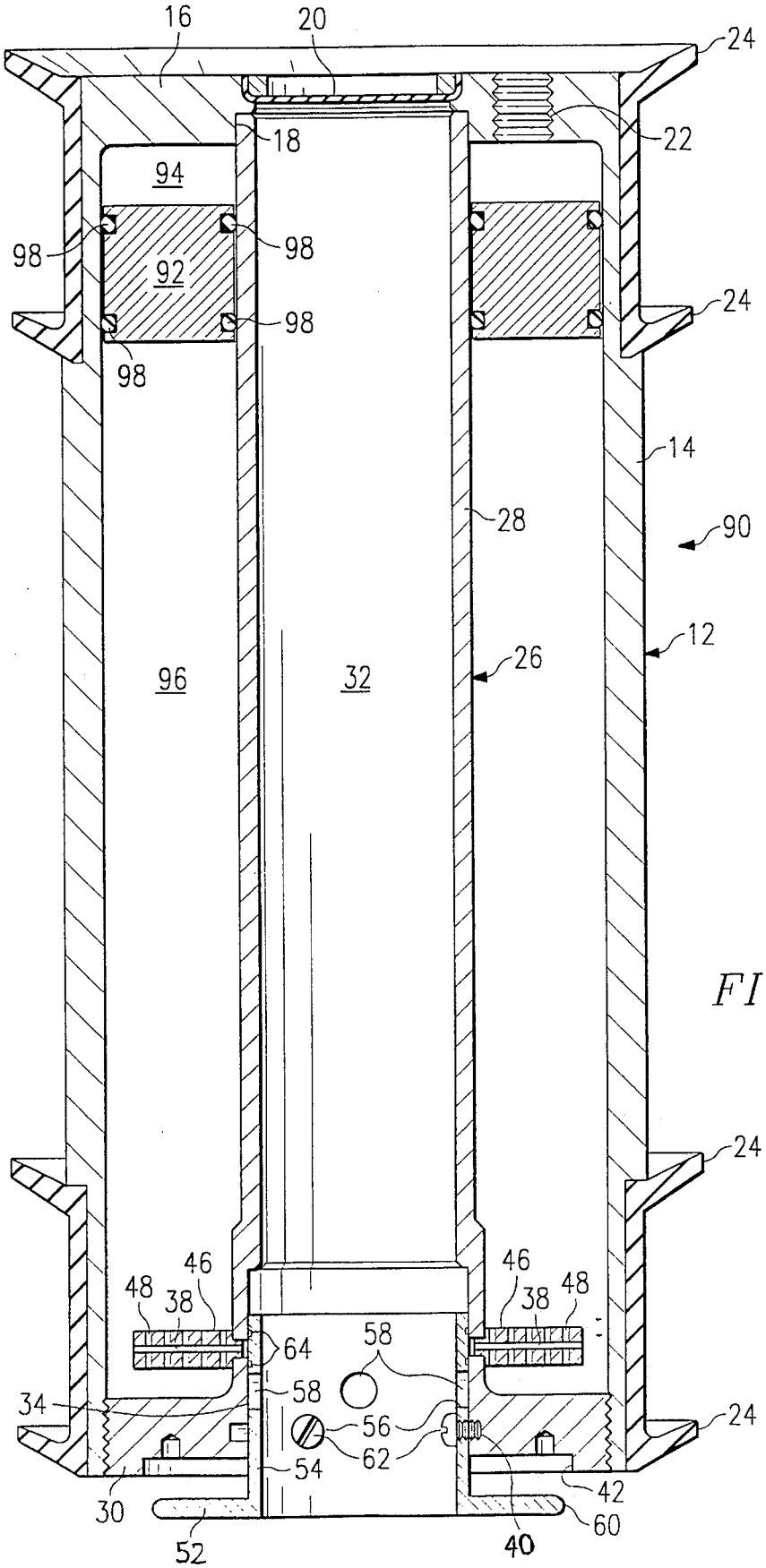
FIG. 3 is a cross-sectional, elevational view of the plug of FIG. 1 incorporating a sliding ring.

FIG. 3 depicts a second embodiment of a downhole injection plug 90 for implementing the method of the present invention. Since the plug 90 contains many elements that are identical to those of the first embodiment, these identical elements are referred to by the same reference numerals and will not be described in any further detail.

According to the second embodiment shown in FIG. 3, there is no bladder 44 or stem 50; rather, a sliding ring 92 is provided which can slide vertically within the annular chamber 36, thus dividing the chamber into an upper chamber portion 94 and a lower chamber portion 96. The lower chamber portion 96 stores fluid, such as a cement slurry accelerator. Fluid, such as downhole cement slurry, may enter, via the opening 22, and fill the upper chamber portion 94. The ring 92 is provided with seals 98 which prevent fluids in the upper and lower cavity portions from mixing.

In accordance with the method of the second embodiment, when the injection plug 90 is pumped down the wellbore 72 (FIG. 2), and impacts the bottom plug 82, the sleeve 52 slides upwardly, and the orifice ports 38 and corresponding sleeve ports 58 align. Cement slurry then flows through the central passageway 32 and sleeve 52 creating thereby a venturi effect at the sleeve ports 58 and a differential pressure across the fluid such that fluid is caused to flow outwardly from the lower chamber 96 into the sleeve 52 and to mix with the cement slurry as in the first embodiment.

Figure 4A:
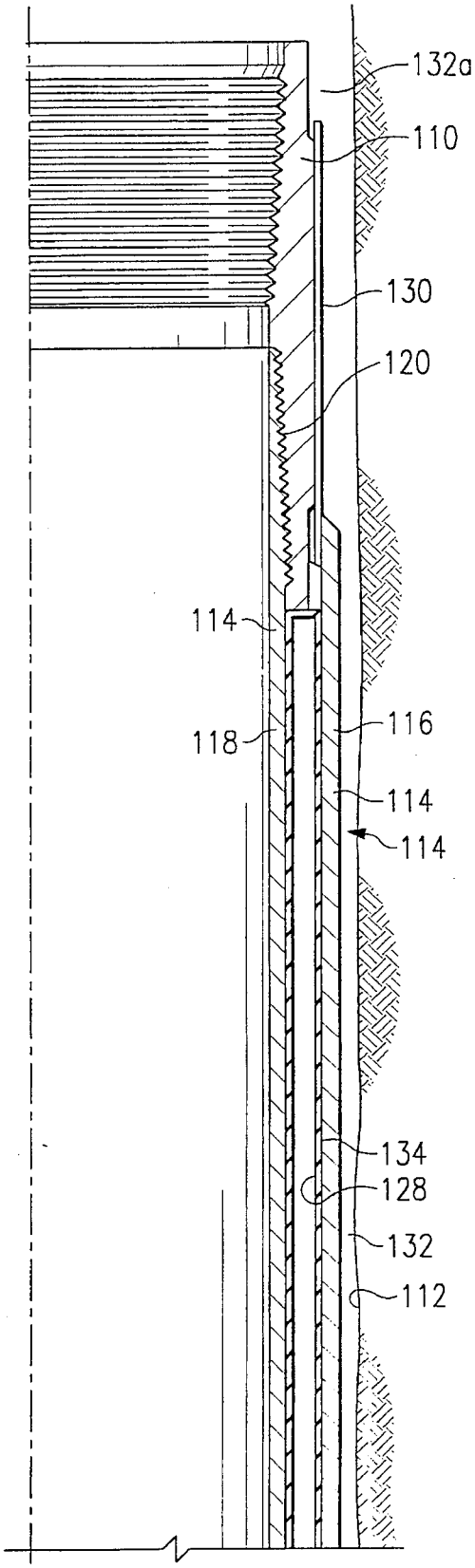
FIG. 4A and 4B are partial, cross-sectional, elevational views of a casing wall having a reservoir that may be utilized to implement the method of the present invention.
Figure 4B:
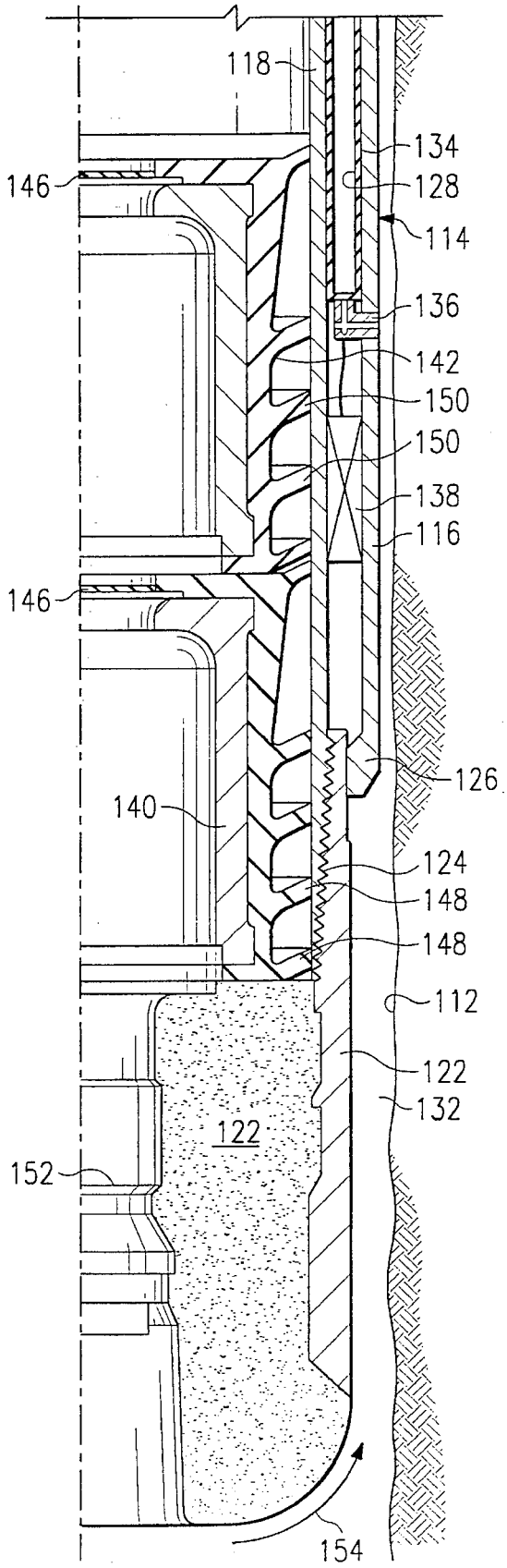

FIGS. 4A and 4B depict a fluid reservoir integrated into the wall of a casing string according to a third embodiment for implementing the method of the present invention. According to the third embodiment shown in FIGS. 4A and 4B, a casing string 110, shown in a wellbore 112, includes a casing portion 114 having an outer casing wall 116 and an inner mandrel 118 coupled together at an interface 120. The lower end of the mandrel 118 is connected to a conventional casing shoe 122 at a threaded connection 124. The lower end 126 of the casing wall 116 fits closely around the upper end of casing shoe 122. The casing wall 116 and the mandrel 118 define an annular chamber 128 therebetween. A vent tube 130 provides fluid communication between the chamber 128 and a well annulus portion 132*a* of an annulus 132, which annulus is defined between the casing 110 and the wellbore 112.

A reservoir elastomeric bladder 134 is disposed in the chamber 128 in a manner similar to the disposition of the bladder 44 in the plug 10 of the first embodiment. The lower end of the bladder 134 is connected to a plurality of solenoid-actuated valves 136 which are normally closed. A battery-powered microprocessor 138 is connected to the solenoid-actuated valves 136 by a connector 140. The microprocessor 138 is adapted for controlling the solenoid-actuated valves 136 and opening it in response to the presence of a magnetic field of a predetermined minimum strength. When the solenoid-actuated valves 136 are opened, fluid communication is established between the interior of the bladder 134 and the annulus 132.

In accordance with the method of the third embodiment of the present invention as shown in FIGS. 4A and 4B, during a cementing operation, a first or bottom plug 140, a second or intermediate plug 142, and a solid core top plug (not shown) are provided. The plugs 140, 142 have hollow cores sealed with diaphragms 144, 146, respectively, to prevent mixing of fluids above and below the diaphragm and to permit a differential pressure to be applied across the plug so that the plug may be pumped down the casing 110. The plugs 140, 142 are further provided with conventional wiper blades 148, 150, respectively, for wiping the inside surface of the well casing 110 free of drilling mud or other fluids present therein and sealingly separating the fluids above and below the respective plugs. Additionally, the intermediate plug 142 is also magnetized sufficiently to exude a magnetic field of the predetermined minimum strength required to signal the microprocessor 138 to open the valve 136.

The first, or bottom, plug 140 is pumped downwardly into the casing 110 until it comes to rest on the casing shoe 122 and seats thereon. Slurry pressure is then increased momentarily until the diaphragm 144 is ruptured. The cement slurry then flows downwardly through the bottom plug 140 and through an opening 152 of the casing shoe 122 and upwardly into the well annulus 132 as indicated by the arrow 154.

After a predetermined amount of cement slurry has been pumped down the casing string 110, the second, or intermediate, plug 142 is pumped down the casing. As the plug 142 passes the microprocessor 138, the latter senses the magnetic field exuded by the plug and actuates the solenoid-actuated valves 136 to establish fluid communication between the bladder 134 and the well annulus 140. As the plug 142 comes to rest on the bottom plug 140, the slurry pressure is increased momentarily until the diaphragm 146 is ruptured.

The cross-sectional area of well annulus 132 is smaller than that of the well annulus 132*a* so that fluid flows at a higher velocity through the well annulus 132 than through the well annulus 132*a*. As in the first embodiment, this increased fluid flow velocity creates a venturi effect with a consequent pressure differential across the casing portion 114. This collapses the bladder 134 so that the fluid therein is forced outwardly through the orifices of the valve 136 into the cement slurry stream flowing upwardly through the well annulus 132.

After a predetermined additional amount of cement slurry has been pumped down the casing 110, the top plug (not shown) is pumped down the casing using a displacement fluid such as mud in a manner substantially identical to that shown in FIG. 3 for the first embodiment. When the top plug comes to rest on the intermediate plug, the cementing operation is complete.

Figure 5A:
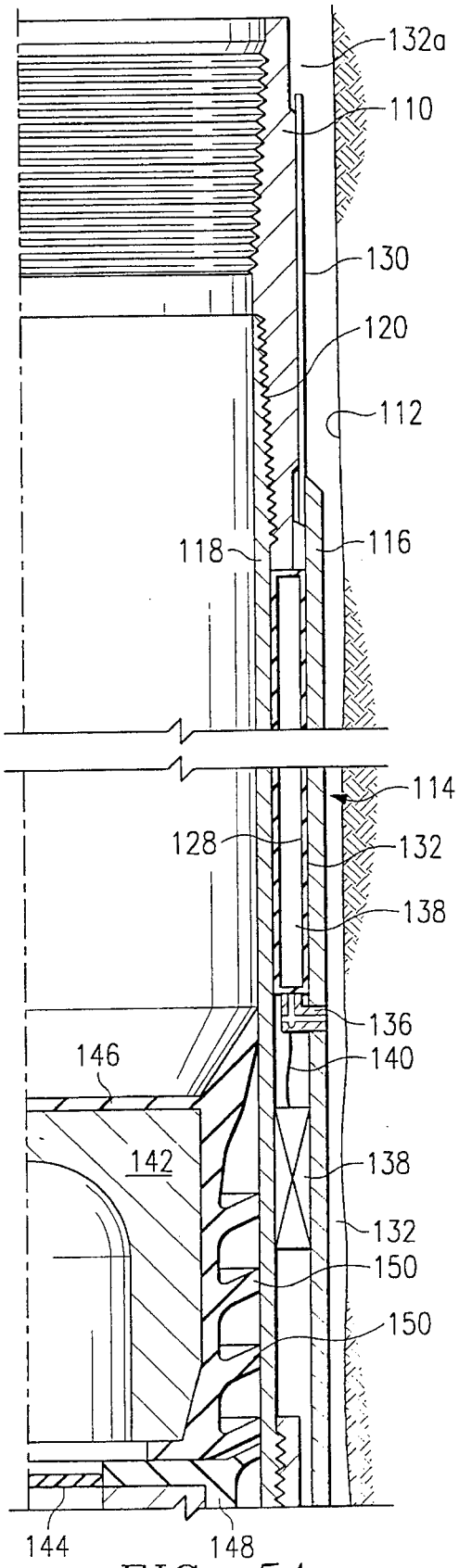
FIGS. 5A and 5B are is a cross-sectional, elevational views of the casing wall of FIG. 4 engaging a cementing valve.
Figure 5B:
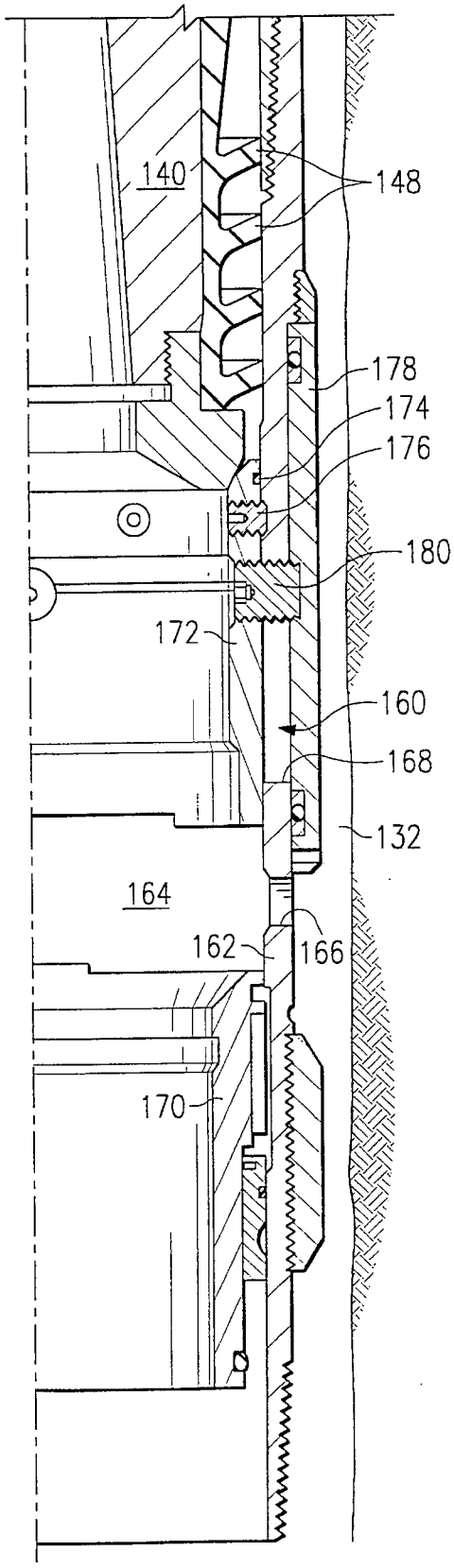

FIGS. 5A and 5B depict a fourth embodiment of a casing string 110 for implementing the method of the present invention. Since the casing string 110 contains many elements that are identical to those of the third embodiment, the identical elements are referred to by the same reference numerals and will not be described in any further detail. The only difference between the third and the fourth embodiments is the inclusion in the latter embodiment of a cementing valve 160 rather than the casing shoe 122 of the third embodiment. Also, the bottom plug 140, rather than the intermediate plug 142 (which is not used in the fourth embodiment), is magnetized sufficiently to exude a magnetic field of the predetermined minimum strength required to signal the microprocessor 138 to open the valve 136.

The cementing valve 160 is of a conventional design and includes a body 162, a central passageway 164 extending longitudinally through the valve, a plurality of cementing ports (or openings) 166 extending radially from the passageway through the body into the annulus 132, and a longitudinal slot 168 located above the cementing ports 166 and extending through the body. An opening sleeve 170 is slidably disposed within the lower end of the body 162. A closing sleeve 172 is disposed within the body 162 above the opening sleeve 170. The closing sleeve 172 has a seat 174 formed at its upper end for receiving the bottom plug 140 and is secured to the body 162 with a shear pin 176. An outer sleeve 178 is slidably disposed outside the body 162. A coupling pin 180 is provided which extends through the slot 168 and into corresponding holes in the closing sleeve 172 and the outer sleeve 178 so that the closing and outer sleeves move together and close the port 166 when the closing sleeve is resting on top of the opening sleeve 170.

In accordance with the fourth embodiment of the present invention, pressure is applied in a conventional manner to move the opening sleeve 170 downwardly to an open position, as shown in FIG. 5B, thereby facilitating fluid communication between the central passageway 164 and the annulus 132 via the port 166. The casing 110 is closed below the valve 160.

A predetermined amount of cement slurry is then pumped down the casing 110 followed by the bottom plug 140 and additional slurry until the bottom plug comes to rest on the seat 174. Slurry pressure is then increased momentarily until the diaphragm 144 is ruptured. The cement slurry then flows downwardly through the bottom plug 140, the central passageway 164 of the closing sleeve 172, through the port 166, and upwardly into the well annulus 132.

As the bottom plug 140 comes to rest on the seat 174, the microprocessor 138 senses the magnetic field exuded by the bottom plug and opens the valve 136 thereby establishing fluid communication between the fluid in the bladder 134 and the well annulus 132. As in the third embodiment, a venturi effect is created with a consequent pressure differential across the casing portion 114. This pressure collapses the bladder 134, forcing the fluid therein outwardly through the orifices of the valves 136 into the cement slurry stream flowing upwardly through the well annulus 132.

After a predetermined amount of additional cement slurry has been pumped down the casing, a solid core top plug (not shown) is pumped down. As the top plug 142 comes to rest upon the upper end of the bottom plug 140, the slurry pressure is momentarily increased until the top and bottom plugs force the closing sleeve 172 in the cementing valve 160 to move downwardly and shear the shear pin 176. Because the outer sleeve 178 is connected to the closing sleeve 172 by the coupling pin 180, the outer sleeve moves downwardly with the closing sleeve to sealingly close the cementing ports 166 to terminate the cementing operation. It is understood that the method of the present invention may be implemented utilizing many forms and embodiments. The embodiments shown herein are intended to illustrate rather than to limit the invention, it being appreciated that variations may be made without departing from the spirit or the scope of the invention. For example, the venturi effect utilized could be supplemented by pre-charging the fluid reservoir (e.g., a bladder or a chamber above a ring) with gas prior to pumping the reservoir downhole to ensure that the fluid flows outwardly from the reservoir when it should. Furthermore, the bladder may include a pump which may meter fluid into a cement slurry stream, which pump may be, for example, a screw or centrifugal type pump powered either electrically (e.g., by a battery) or hydraulically (e.g., from the flow of slurry).

In further embodiments, a ring could be used in the fluid reservoir of the third or fourth embodiments in place of a bladder in a manner analogous to that described in relation to the second embodiment.

In still further embodiments, one or more of the aforementioned embodiments may be used in various combinations at multiple points in a wellbore. For example, the plug disclosed in the first embodiment may be introduced at any point in the slurry or used to inject fluid at the bottom of the wellbore while at the same time fluid is injected into an upper region of the wellbore using the fourth embodiment described above. Furthermore, the third embodiment described above may be connected at its lower end to other casing rather than a casing shoe, thereby enabling it to be used in an upper region of the wellbore.

In still further embodiments, the method may include injecting a variety of types of fluids at any point in a subterranean wellbore, and, with respect to cement slurries therein, to effect one or more of the following: accelerate or retard the WOC, control fluid loss in the cement, gel the cement, increase or decrease the slurry's weight or density, increase the mechanical strength of the cement when set, reduce the effect of mud on the cement, or improve the cement's bonding. Such fluids used primarily during cementing operations are known in the art and include accelerators, retarders, fluid loss agents, and friction reducers in a variety of forms commercially available to and commonly used in the industry. Such fluids used primarily during stimulation operations are known in the art and include cross-linking polymers, gel breakers, and corrosion inhibitors known to and commonly used in well fracturing and acidizing procedures. Such accelerators include: metal chlorides such as calcium chloride, sodium chloride, potassium chloride; alkali metal silicates such as sodium metasilicate, sodium silicate, potassium silicate; amines such as triethanolamine, diethanolamine, monoethanolamine; amides such as formamide; organic acids such as acetic formic acid; esters of organic acids such as the first four carbon esters of formic acid, methyl formate, ethyl formate, normal-propyl formate, isopropyl formate, normal-butyl formate, iso-butyl formate, and t-butyl formate; sodium fluoride solutions; and salts of formic acid such as mixtures thereof and the like. Retarders include tartaric acid, sodium glucoheptonate, glucono-delta lactone, sodium lignosulfonate, and the like. Fluid loss agents include polyethyleneimine, polyalkaline polyamine, styrene butadiene, polyvinyl alcohol, and the like. Friction reducers include polynapthalene sulfonate, sulfonic acid, calcium lignosulfonate, quebracho, and the like. Cross-linking polymers include borate, zirconium lactate, titanium solutions, and the like. Gel breakers include ammonium persulfate, oxalic acid, hydrochloric solutions, and the like. Corrosion inhibitors include gluteraldehyde, potassium iodide, corban, and the like.

In still further embodiments, the method of the present invention may include mixing slurry and injected fluid by utilizing baffle plates inside the shoe or cementing valve. The method may also include utilizing a greater or lesser number of ports, shear pins, orifice blocks, solenoid valves, or the like than described hereinabove.

In still further embodiments, the method of the present invention may include using a magnetized ball or dart instead of a magnetized plug to effect a signal to a microprocessor. Such signal may also be effected by irradiating a portion of the slurry, as by adding a radioactive tracer thereto, and releasing fluid from the reservoir only into the irradiated portion, or, conversely, only into the nonirradiated slurry. Such signal may further be effected mechanically by a trip hammer or a shear pin protruding into the casing; the port sleeve or valve may be opened when the hammer or pin are tripped or sheared, respectively, as by a plug, ball, or dart moving down the casing. Furthermore, a trip hammer or a shear pin may be used to actuate a pressurized canister of, for example, $CO_2$, to open a port sleeve or valve.

Although illustrative embodiments have been shown and described, a wide range of modification, change, and substitution is intended in the foregoing disclosure and in some instances, some steps of the present invention may be employed without a corresponding use of the other steps. Accordingly, it is appropriate that the appended claims be construed broadly and in a manner consistent with the scope of the invention.

What is claimed is:

1. A method for containing a first fluid in an intermediate plug and disposing said intermediate plug in a wellbore, comprising the following steps in the sequence set forth:

storing said first fluid in a reservoir in said intermediate plug;

pumping said intermediate plug down a casing string in said wellbore until said intermediate plug lands on a bottom wiper plug; and transferring said first fluid into a second fluid as said second fluid flows within said wellbore.

2. The method of claim 1 wherein said reservoir is selected from the group consisting of a bladder, a piston, and a collapsible housing.

3. The method of claim 1 wherein said second fluid is selected from the group consisting of a cement slurry, a completion fluid, and a stimulation fluid.

4. The method of claim 1 wherein said first fluid is for treating said second fluid.

5. The method of claim 1, further comprising, before the step of transferring, the step of waiting a predetermined amount of time.

6. The method of claim 1, wherein the step of transferring includes the step of injecting said treating fluid into said second fluid.

7. A method for containing a first fluid in a device, wherein said device forms an integral portion of a casing string, and setting said casing string in a wellbore, comprising the following steps in the sequence set forth:

storing said first fluid in a reservoir in said device;

positioning said device in said wellbore at or above a casing shoe; and passing an activation object down said casing, sensing when said object is proximal to said device, and upon sensing that said object is proximal to said device, releasing said first fluid into a second fluid flowing within said wellbore externally of said casing.

8. The method of claim 7 wherein said object is a dart, a ball, or a plug.

9. The method of claim 7 wherein said reservoir is selected from the group consisting of a bladder, a piston, and a collapsible housing.

10. The method of claim 7 wherein said second fluid is selected from the group consisting of cement slurry, a completion fluid, and a stimulation fluid.

11. The method of claim 7 wherein said first fluid is for treating said second fluid.

12. The method of claim 7, further comprising, before the step of transferring, the step of waiting a predetermined amount of time.

13. The method of claim 7, wherein the step of transferring includes the step of injecting said treating fluid into said second fluid.

14. A method for containing in a device an accelerator for reducing the thickening time for a cement slurry, to reduce the detrimental effects of over-retardation, mud contamination, poor surface mixing of said slurry, and poor slurry design, and disposing said device in a wellbore, said method comprising the following steps in the sequence set forth:

storing said accelerator in a reservoir in said device;

positioning said device in said wellbore at a desired location; and transferring said accelerator into said slurry as said slurry flows within said wellbore.

15. A method for containing in a device an accelerator for reducing the thickening time for a cement slurry, to control excessive fluid loss from said slurry and lost circulation of said slurry, and disposing said device in a wellbore, said method comprising the following steps in the sequence set forth:

storing said accelerator in a reservoir in said device;

positioning said device in said wellbore at a desired location; and transferring said accelerator into said slurry as said slurry flows within said wellbore.

16. A method for containing in a device an accelerator for reducing the transition-to-set time for a cement slurry, to reduce cement fall-back and U-tubing, to improve cement bonding by improving control of cement shrinkage, and to control gas and fluid migration into a static cement column prior to the set of said column, and disposing said device in a wellbore, said method comprising the following steps in the sequence set forth:

storing said accelerator in a reservoir in said device;

positioning said device in said wellbore at a desired location; and transferring said accelerator into said slurry as said slurry flows within said wellbore.

17. A method for containing in a device an accelerator for accelerating, with respect to a cement slurry, the cement hardening process and reducing the waiting on cement (WOC) time for said slurry, to reduce the time required for testing, logging, drillout, and completion of a well, and to shorten the time to meet Federal, State, and local government regulations governing cement set procedures, and disposing said device in a wellbore, said method comprising the following steps in the sequence set forth:

storing said accelerator in a reservoir in said device;

positioning said device in said wellbore at a desired location; and transferring said accelerator into said slurry as said slurry flows within said wellbore.

18. A method for containing in a device an accelerator for treating said slurry, to reduce the problems which may occur when said slurry is over-retarded so that it may be pumped down into deep wells, and to minimize the risks of a premature set of said slurry which could result from an early reaction of said accelerator with said slurry if said accelerator were transferred into said slurry using conventional processes, and disposing said device in a wellbore, said method comprising the following steps in the sequence set forth:

storing said accelerator in a reservoir in said device;

positioning said device in said wellbore at a desired location; and transferring said accelerator into said slurry as said slurry flows within said wellbore.

19. A method for injecting a first fluid into a second fluid in a subterranean wellbore, said wellbore having a casing extending therein, the method comprising the steps of:

storing said first fluid in a reservoir defined by annular space surrounding a central passageway in a plug, said reservoir having an opening which extends into said passageway, through which opening said first fluid may flow from said reservoir, and wherein said plug includes a sliding valve sleeve operable in a first position for preventing said first fluid from flowing through said opening, and in a second position for allowing said first fluid to flow through said opening;

while maintaining said sleeve in said first position, pumping said plug down said casing;

sliding said sleeve into said second position;

causing said second fluid to flow through said passageway so as to create a pressure drop across said opening, thereby inducing said first fluid to flow out of said reservoir through said opening into said second fluid.

20. A method for injecting a first fluid into a second fluid in a subterranean wellbore, said wellbore having a casing extending therein, the method comprising the steps of:

storing said first fluid in a deflatable bladder contained within an annular space surrounding a central passageway in a plug, said bladder having an opening through which said first fluid may flow from the interior of said bladder into said passageway;

pumping said plug down said casing to locate said bladder in said wellbore; and applying pressure to deflate said bladder and causing said second fluid to flow through said passageway so as to create a pressure drop across said opening, so that said first fluid flows out of said bladder through said opening into said second fluid.

21. A method for injecting a first fluid into a second fluid in a subterranean wellbore, the method comprising the steps of:

storing said first fluid in a reservoir defined by an annular space enclosed within the wall of a portion of a string of casing, said reservoir having an opening through which said first fluid may flow from said reservoir into an annulus defined between said casing and said wellbore;

setting said casing in said wellbore; and causing said second fluid to flow through said annulus so as to create a pressure drop across said opening, thereby inducing said first fluid to flow out of said reservoir through said opening into said second fluid.

22. The method of claim 21 wherein said reservoir further includes a deflatable bladder having fluid communication with said annulus, and said step of causing includes creating a differential pressure which deflates said bladder.

23. A method for injecting into a cement slurry in a subterranean wellbore an accelerator effective for reducing the time required for said cement slurry to harden, the method comprising the steps of:

storing said accelerator in a reservoir having an opening through which said accelerator may flow from said reservoir;

locating said reservoir in said wellbore; and causing said cement slurry to flow so as to create a pressure drop across said opening, thereby inducing said accelerator to flow out of said reservoir through said opening into said cement slurry.

24. The method of claim 23 wherein said accelerator is a composition selected from the group consisting of silicates, amines, amides, organic acids, and salt solutions.

25. A method for injecting into a cement slurry in a subterranean wellbore a composition selected from the group consisting of accelerators, retarders, fluid loss agents, and friction reducers, the method comprising the steps of:

storing said composition in a reservoir having an opening through which said composition may flow from said reservoir;

locating said reservoir in said wellbore; and causing said cement slurry to flow so as to create a pressure drop across said opening, thereby inducing said composition to flow out of said reservoir through said opening into said cement slurry.

26. A method for injecting into a stimulation fluid in a subterranean wellbore a composition selected from the group consisting of cross-linking polymers, gel breakers, and corrosion inhibitors, the method comprising the steps of:

storing said composition in a reservoir having an opening through which said composition may flow from said reservoir;

locating said reservoir in said wellbore; and causing said stimulation fluid to flow so as to create a pressure drop across said opening, thereby inducing said composition to flow out of said reservoir through said opening into said stimulation fluid.

* * * * *